US008094860B2

(12) United States Patent
Huang

(10) Patent No.: US 8,094,860 B2
(45) Date of Patent: Jan. 10, 2012

(54) PORTABLE SOUND BOX ASSEMBLY

(76) Inventor: Tian-Xu Huang, Sichuan (CN)

( * ) Notice: Subject to any disclaimer, the term of this patent is extended or adjusted under 35 U.S.C. 154(b) by 562 days.

(21) Appl. No.: 12/345,672

(22) Filed: Dec. 30, 2008

(65) Prior Publication Data

US 2009/0175483 A1 Jul. 9, 2009

(30) Foreign Application Priority Data

Jan. 4, 2008 (CN) ..... 2008 2 0091514

(51) Int. Cl.
*H04R 1/02* (2006.01)

(52) U.S. Cl. ..... 381/386; 381/300; 381/306; 381/332; 381/336; 381/345; 181/147; 181/153; 181/157; 181/198

(58) Field of Classification Search ..... 381/300–388, 381/181, 182, 395; 181/199
See application file for complete search history.

(56) References Cited

U.S. PATENT DOCUMENTS

| | | | | | |
|---|---|---|---|---|---|
| D607,876 | S | * | 1/2010 | Huang | D14/216 |
| D610,572 | S | * | 2/2010 | Skurdal | D14/216 |
| D610,573 | S | * | 2/2010 | Joseph | D14/216 |
| D620,480 | S | * | 7/2010 | Garrett | D14/216 |
| D635,554 | S | * | 4/2011 | Lee | D14/216 |
| D643,408 | S | * | 8/2011 | Huang | D14/216 |

* cited by examiner

*Primary Examiner* — Jarrett Stark
*Assistant Examiner* — Lawrence Tynes, Jr.
(74) *Attorney, Agent, or Firm* — Raymond Y. Chan; David and Raymond Patent Firm

(57) ABSTRACT

The present invention generally relates to stereo sound boxes, and more particularly to a sound box assembly containing micro stereo sound boxes joined magnetically together. The sound box assembly contains at least a pair of sound boxes with magnets of opposite polarities, respectively, so that the sound boxes could be magnetically attracted together for convenient transportation and then later could be easily detached for placing apart to achieve superior stereo sound.

9 Claims, 2 Drawing Sheets

PORTABLE SOUND BOX ASSEMBLY

TECHNICAL FIELD OF THE INVENTION

The present invention generally relates to stereo sound boxes, and more particularly to a sound box assembly containing micro stereo sound boxes joined magnetically together.

DESCRIPTION OF THE PRIOR ART

Following the advancement of technology and the ubiquity of computer and network various digital products such as MP3 player, MP4 player, digital camera, etc. are continuously introduced into people's work and life. Among them, the portable digital audio and video players such as MP3 and MP4 players are most popular. Originally, these players are designed to use with earphones but recently micro sound boxes specifically designed to accompany these portable players are emerging. Usually, these sound boxes are separately powered and, in order to provide stereo sound, these sound boxes come in pairs. For appropriate stereo effect, two of these sound boxes have to be placed at a distance apart and, as such, they are not designed to pack or stack together, making their usage and transportation rather inconvenient. There are also stereo speakers integrated in a single sound box for high portability, but at the cost of sacrificing its stereo effect. In other words, a user has to choose between portability and stereo effect, but cannot attain both simultaneously.

SUMMARY OF THE INVENTION

Therefore, a purpose of the present invention is to provide a sound box assembly where sound boxes are magnetically joined together for convenient transportation and then later could be easily detached for placing at a distance apart to achieve superior stereo sound.

To achieve the foregoing purpose, the sound box assembly taught by the present invention contains at least a pair of sound boxes with magnets of opposite polarities, respectively, so that the sound boxes could be magnetically attracted together Both tenons and mortises are provided on the interfacing surfaces of the sound boxes so that, when the sound boxes are joined, the tenons on one sound box are plugged into the mortises of the other sound box.

Also on the interfacing surfaces of the sound boxes, there are mating electrical plug and socket for the transmission of audio signals from one sound box to another.

The plug contains a number of metallic pins and the socket contains metallic springs and blades for clamping the metallic pins.

Each sound box contains a casing, and a speaker and a circuit board housed inside the casing. The casing contains a back case and a middle case fixedly joined together, and a front case connected to the middle case via a bellows-like collapsible resonant chamber.

Each sound box contains an audio socket for connection to an audio output port of an audio player.

Among the tenons and mortises, at least a pair of matching limiting tenon and limiting mortise is specifically configured with a ridge and a notch notch, respectively, to guarantee the sound boxes are aligned correctly during assembly.

With the foregoing technical features, the sound box assembly of the present invention provides the following advantages. First, with the configuration of magnets, the sound boxes of the present invention could be conveniently assembled. The sound boxes could also be conveniently detached apart for superior stereo effect. Then, by the configuration of tenons and mortises along the sound boxes' interfacing surfaces to withstand twisting forces, the assembly of the sound boxes is more reliable during transportation. Further, by providing matching ridge and notch on a pair of limiting tenon and limiting mortise, the sound boxes are guaranteed to be aligned correctly during their assembly, thereby preventing the electrical plug and socket from being damaged. The provision of the plug and socket establishes an audio signal transmission path between sound boxes so that only a single sound box needs to be hooked up with the audio player, thereby making the cabling of the sound box assembly simpler and more convenient. Additionally, by clamping the metallic pins of the plug with metallic springs or blades of the socket, the electrical connection between the sound boxes is simple yet very reliable.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
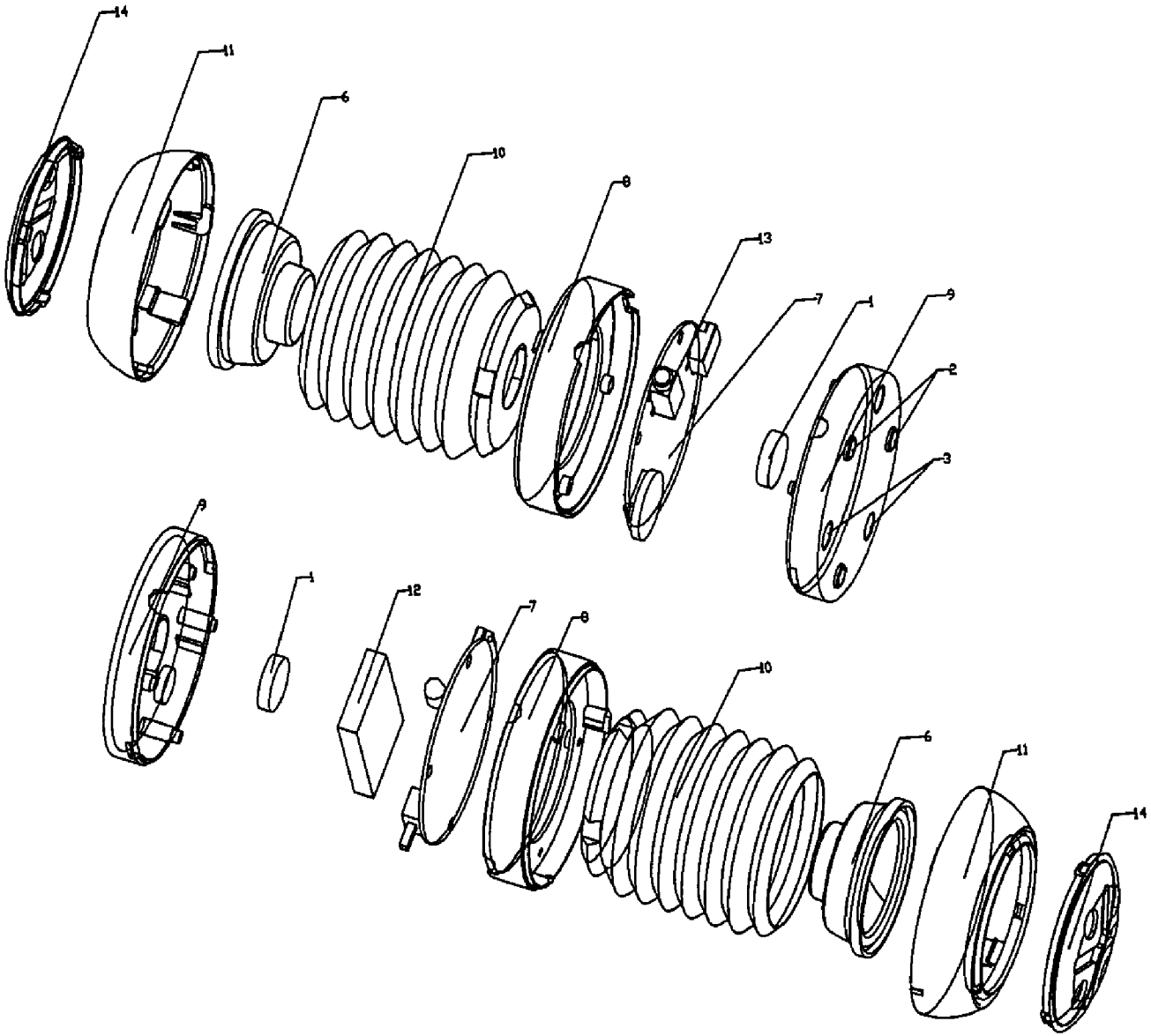
FIG. 1 is a perspective exploded diagram showing the various components of the sound box assembly according to an embodiment of the present invention.
Figure 2:
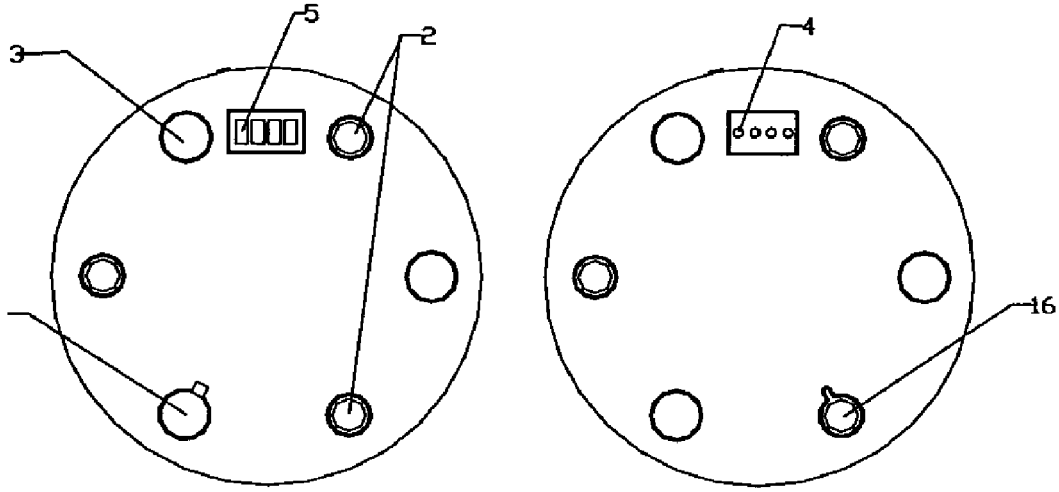
FIG. 2 is a schematic diagram showing the interfacing surfaces of two sound boxes of the sound box assembly of FIG. 1.
Figure 3:
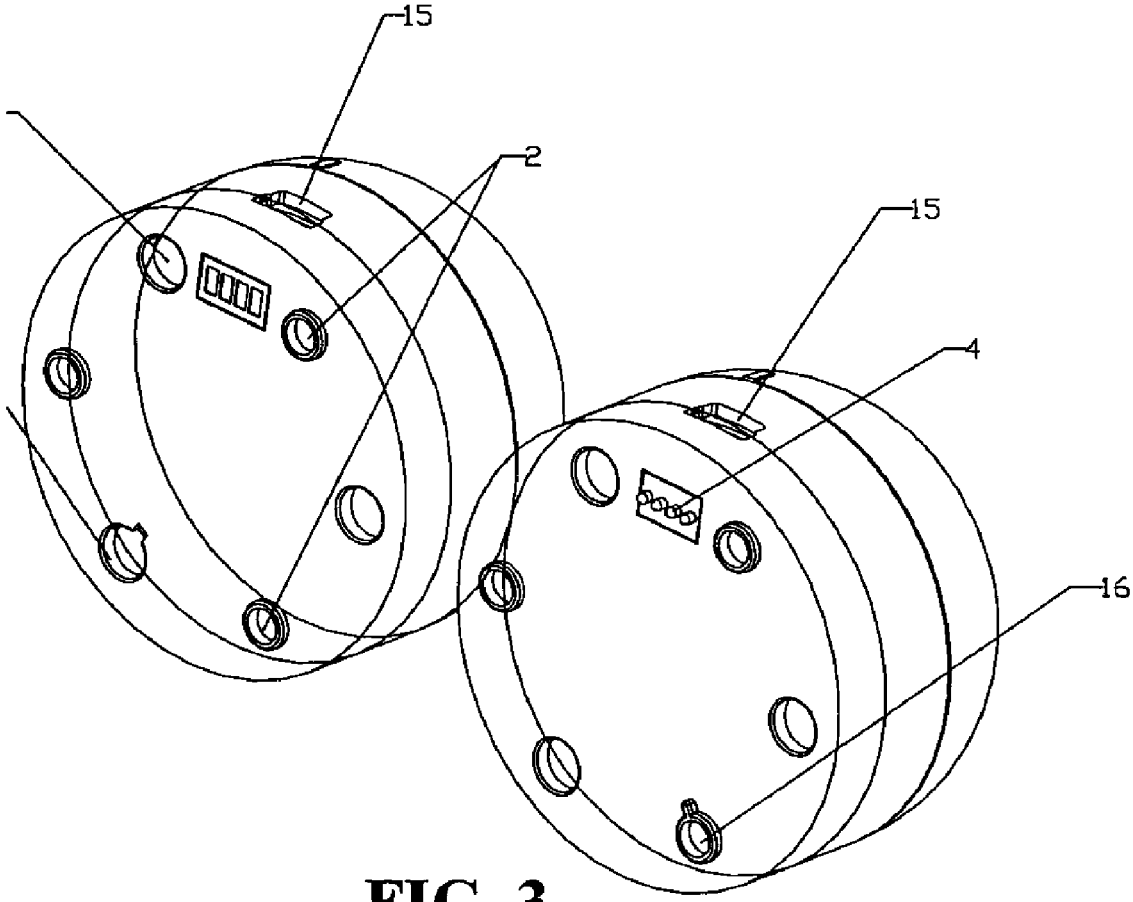
FIG. 3 is a perspective diagram showing the interfacing surfaces of two sound boxes of the sound box assembly of FIG. 1.

As shown in FIGS. 1 to 3, the sound box assembly according to an embodiment of the present invention contains at least a pair of sound boxes, each having a magnet 1. The magnets 1 could be configured on any surface of the sound boxes as long as their residing surfaces are relatively flat so that the sound boxes could be interfaced therewith. The magnets 1 are of opposite polarities and, as such, the two sound boxes could be magnetically attracted together by the magnets 1 to constitute the sound box assembly of the present invention.

To further enhance the reliability of the sound boxes' coupling, one or more tenons 2 and one or more mortises 3, each at a distance from each other, are provided on each of the interfacing surfaces of the sound boxes. When two sound boxes are joined together, the tenons 2 of one sound box are plugged into the mortises 3 of the other sound box. The external twisting forces received by the sound boxes during their usage and transportation are thereby mainly withstood by the mutual locking of the tenons 2 and mortises 3, leaving the magnets 1 to resist forces to separate the sound boxes only. In this way, the stability of the sound box assembly is significantly improved. The tenons 2, when the sound boxes are separated, could be used as stands to the sound boxes to prevent abrasion to the bottom surfaces of the sound boxes. In order for the tenons 2 to provide reliable support to the sound boxes, the tenons 2 are arranged uniformly along the bottom surface of a sound box. Among the tenons 2 and mortises 3 of two connecting sound boxes, at least a pair of matching tenon 2 (referred to as limiting tenon 16) and mortise 3 (referred to as limiting mortise 17) are specially configured to guarantee that the sound boxes could be joined only according to a specific orientation so that an electrical plug 4 is correctly received by a socket 5. In order to achieve this, the limiting tenon 16 has a ridge extended axially along its body and correspondingly the limiting mortise 17 has a notch at its opening to receive the ridge.

As shown in FIGS. 2 and 3, for the transmission of audio signal from one sound box to the other joining sound box, a special connection means is adopted which contains a plug 4 and a socket 5 on the interfacing surfaces of the sound boxes, respectively. To facilitate their connection, the plug 4 has two or more metallic pins for threading into two or more corresponding openings to establish electrical contacts with metallic springs or resilient metallic blades inside the openings. As shown in FIGS. 2 and 3, since stereo audio signals are to be transmitted, the plug 4 has four pins in the present embodiment. If there are more audio channels, the number of pins and openings of the plug 4 and the socket 5 could be increased as required.

As shown in FIG. 1, each sound box has a collapsible casing, and a speaker 6 and a circuit board 7 housed inside the casing. The casing contains a back case 9, a middle case 8, and a front case 11. The back case 9 and the middle case 8 are fixedly joined together, and the speaker 6 and the circuit board 7 are housed in the space formed by the back and middle cases 9 and 8. The middle case 8 and the front case 11 are joined with a bellows-like collapsible resonant chamber 10. A front surface of the front case 11 is covered by a mesh lid 14. When the resonant chamber 10 is expanded, its volume is significantly increased and the tone quality of the sound box is greatly enhanced, especially for the mid- to lower-frequency audio signals.

Since the sound boxes' audio signals are from a portable player with limited power, the sound boxes could further contain a rechargeable battery 12 so that the sound boxes could be driven by their own power supply without consuming the portable player's power. The battery 12 is connected to a power socket 15 provided on the wall of the sound boxes. The power socket 15 could adopt a standard connector such as USB and an external power source could be connected via the power socket 15 to recharge the battery 12.

An audio socket 13 is also provided on the wall of the sound boxes for connecting the sound boxes to an audio output port of a portable player via a cable. When the two sound boxes are joined together, the portable player only needs to be connected to one of the sound boxes and the audio signals are transmitted to the other sound box via the aforementioned plug 4 and socket 5.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A sound box assembly, comprising at least a pair of sound boxes;

wherein each of said sound boxes has a magnet of a polarity opposite to that of the other magnet such that said sound boxes are joined together into said sound box assembly by magnetic attraction between said magnets.

2. The sound box assembly according to claim 1, each of said sound boxes has a plurality of tenons and mortises along a interfacing surface with the other sound box so that said tenons of one sound box are received by corresponding mortises of the other sound box.

3. The sound box assembly according to claim 2, wherein said tenons and said mortises contains at least a pair of matching limiting tenon and limiting mortise for correct alignment of said sound boxes during assembly; said limiting tenon has a ridge extended axially along the body of said limiting tenon; and said limiting mortise has a notch at the opening of said limiting mortise for receiving said ridge.

4. The sound box assembly according to claim 1, wherein an electrical plug for transmission of audio signals is provided on said interfacing surface of one sound box; and a matching socket is provided on said interfacing surface of the other sound box.

5. The sound box assembly according to claim 4, wherein said plug and said socket comprise a plurality of matching terminals.

6. The sound box assembly according to claim 5, wherein said terminals of said plug are metallic pins; and said terminals of said socket are metallic springs or blades for clamping said metallic pins.

7. The sound box assembly according to claim 1, wherein each of said sound box comprises a casing, and a speaker and a circuit board housed inside said casing; said casing comprises a back case and middle case fixedly joined together; and said casing further comprises a bellows-like collapsible resonant chamber connecting said middle case and a front case.

8. The sound box assembly according to claim 1, wherein each of said sound boxes contains a rechargeable battery connected to a power socket on a casing of said sound box.

9. The sound box assembly according to claim 1, wherein each of said sound boxes contains an audio socket on a casing of said sound box for connection to an audio output port of an audio player via a cable.

* * * * *